US008974355B2

(12) United States Patent
Austin

(10) Patent No.: US 8,974,355 B2
(45) Date of Patent: Mar. 10, 2015

(54) BOARD EXERCISE DEVICE

(71) Applicant: Charles A Austin, San Marcos, TX (US)

(72) Inventor: Charles A Austin, San Marcos, TX (US)

( * ) Notice: Subject to any disclaimer, the term of this patent is extended or adjusted under 35 U.S.C. 154(b) by 246 days.

(21) Appl. No.: 13/847,479

(22) Filed: Mar. 19, 2013

(65) Prior Publication Data

US 2014/0287894 A1 Sep. 25, 2014

(51) Int. Cl.
*A63B 26/00* (2006.01)
*A63B 21/04* (2006.01)

(52) U.S. Cl.
CPC ..... *A63B 26/00* (2013.01)
USPC ..... 482/142; 482/23; 482/130

(58) Field of Classification Search
CPC ..... A63B 6/00; A63B 21/04; A63B 21/0442; A63B 21/055; A63B 21/0552; A63B 21/0557; A63B 21/16
USPC ..... 482/23, 51, 52, 70, 71, 92–96, 482/121–123, 126, 129–132, 142
See application file for complete search history.

(56) References Cited

U.S. PATENT DOCUMENTS

| | | | | | |
|---|---|---|---|---|---|
| 4,478,413 | A * | 10/1984 | Siwula | 482/127 |
| 5,076,571 | A * | 12/1991 | Croce et al. | 472/90 |
| 5,322,490 | A * | 6/1994 | Van Der Hoeven | 482/51 |
| 5,326,338 | A * | 7/1994 | Makous | 482/51 |
| 6,110,083 | A * | 8/2000 | Riser | 482/142 |
| 7,207,932 | B1 * | 4/2007 | Dean | 482/140 |
| 8,512,142 | B2 * | 8/2013 | Meldeau | 463/39 |
| 2007/0087920 | A1 * | 4/2007 | Dachraoui et al. | 482/123 |
| 2013/0090216 | A1 * | 4/2013 | Jackson | 482/52 |

* cited by examiner

*Primary Examiner* — Oren Ginsberg

(57) ABSTRACT

A board exercise device that includes a pair of planar boards having a top surfacing with a perimeter and an outer edge, the built-in attachment bars are coupled to the perimeter of the pair of planar boards and include an attachment aperture and a stem portion and one or more banded exercise devices coupled to the built-in attachment bars and allow a user to grasp the one or more banded exercise devices and perform an exercise. The board exercise device also includes a pair of handles coupled to a top of the outer edge of the pair of planar boards that are grasped by the user to transport the board exercise device when the board exercise device is in a folded position and a slide board placed over the top surfacing of the pair of planar boards.

20 Claims, 4 Drawing Sheets

BOARD EXERCISE DEVICE

BACKGROUND OF THE INVENTION

1. Field of the Invention

The present invention is an exercise device. More specifically, the present invention is a board exercise device.

2. Description of the Related Art

There are many different types of exercise equipment. Some equipment is designed to be utilized in a health club or a gym and some equipment is designed to be utilized at home. Many types of equipment can only provide a cardio or a muscle building workout.

BRIEF SUMMARY OF THE INVENTION

The present invention is an exercise device. More specifically, the present invention is a board exercise device.

The board exercise device includes a pair of planar boards having a top surfacing with a perimeter and an outer edge, a plurality of built-in attachment bars coupled to the perimeter of the pair of planar boards, the built-in attachment bars each include an attachment aperture and a stem portion and one or more banded exercise devices coupled to the built-in attachment bars and allow a user to grasp the one or more banded exercise devices and perform an exercise. The pair of handles coupled to a top of the outer edge of the pair of planar boards are grasped by the user to transport the board exercise device when the board exercise device is in a folded position and a slide board placed over the top surfacing of the pair of planar boards, the slide board includes a top surfacing, a bottom surfacing and a pair of ends.

It is an object of the present invention to provide a board exercise device that allows a user to utilize a plurality of one or more banded exercise devices.

It is an object of the present invention to provide a board exercise device that includes a sliding board to perform cardiovascular sliding type of exercises.

It is an object of the present invention to provide a board exercise device that includes a pair of handles to easily grasp and transport the board exercise device.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
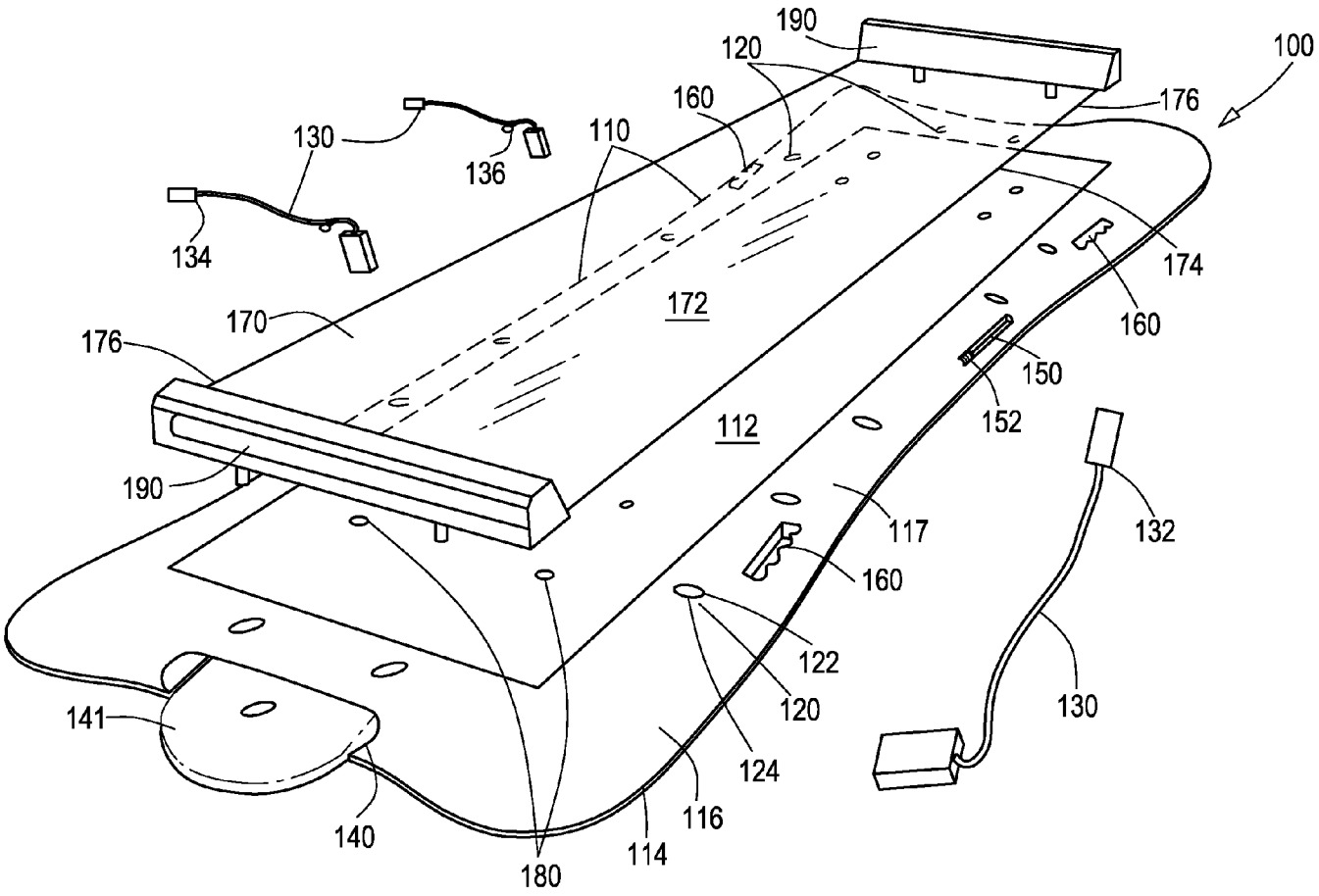
FIG. 1 illustrates an exploded top perspective view of a board exercise device, in accordance with one embodiment of the present invention.

FIG. 1 illustrates an exploded top perspective view of a board exercise device 100, in accordance with one embodiment of the present invention.

The board exercise device 100 includes a pair of planar boards 110, a plurality of built-in attachment bars 120, one or more banded exercise devices 130, a storage slot 140, a sliding adjustment 150, a pair of handles 160 and a slide board 170. The pair of planar boards 110 has a top surfacing 112 with a perimeter 114 and an outer edge 116. The pair of planar boards 110 can be folded out flat and can be utilized by a user in a standing position, a sitting position, a kneeling position or any other suitable position. FIG. 1 illustrates the pair of planar boards 110 folded out flat. The top surfacing 112 is slip-resistant and flat and made of rubber or other suitable material. The pair of planar boards 110 can be made of any suitable type of board such as a wood board, a plastic board or other suitable type of material. The built-in attachment bars 120 are recessed within a plurality of attachment apertures 122 and include a stem portion 124 extended across the attachment apertures 122. The built-in attachment bars 120 are disposed on the perimeter 114 of the top surface 112 of the pair of planar boards 110. The one or more banded exercise devices 130 are coupled to the built-in attachment bars 120 and allow the user to grasp the one or more banded exercise devices 130 and perform a desired exercise with the one or more banded exercise devices 130. The one or more banded exercise devices 130 can be coupled to the built-in attachment bars 120 with any suitable coupling device such as a hook (not shown), a clip (not shown) or other suitable fastener. Other banded exercise devices 130 include a banded belted loop 134, a banded exercise hook 136 to accommodate a barbell or a dumbbell (not shown) or other suitable banded and non-banded exercise device. A user can utilize a board exercise device 100 in a standing position doing a bicep curl with a banded handle 132, although the user can utilize any one or more banded exercise devices 130 or other suitable devices in combination with the board exercise device 100. The storage slot 140 can be disposed on one or more locations of the board exercise device 100. The storage slot 140 can be utilized to contain a barbell plate 141 or other suitable exercise item. The sliding adjustment 150 includes a sliding button 152 that keeps the board exercise device 100 flat. Additional details are provided in FIG. 4 regarding the sliding adjustment 150.

The pair of handles 160 can be built-into a top 117 of the outer edge 116 of the pair of planar boards 110, although the pair of handles 160 can be coupled at any suitable portion of the outer edge 116 of the pair of planar boards 110. The pair of handles 160 includes a plurality of ergonomic ridges 162 that accommodate a user's hand while the user is grasping the pair of handles 160. The pair of handles 160 can be grasped by a user to transport the board exercise device 100 when the board exercise device 100 is in a folded position. The board exercise device 100 includes a slide board 170. The slide board 170 includes a top surfacing 172, a bottom surfacing 174 and a pair of ends 176. The slide board 170 can be placed over the top surfacing 112 of the pair of planar boards 110. The slide board 170 is made of a hard, smooth and transparent plastic or PLEXIGLAS® and allows a user to slide along the slide board 170. The top surfacing 172 of the slide board 170 has a plurality of apertures 180 that can receive and secure one or more banded exercise devices 130 to allow a user to utilize the one or more banded exercise devices 130. The top surfacing 172 of the slide board 170 can be slid on by a user as part of an exercise that is typically a cardiovascular type of exercise such as sliding back and forth across the top surfacing 172. The bottom surfacing 174 of the slide board 170 prevents the slide board 170 from coming off of the top surfacing 112 of the pair of planar boards 110. A raised stop 190 is disposed on each of the pair of ends 176 of the slide board 170 to prevent a user from sliding off of the top surfacing 172 of the slide board 170 without injuring the user. The raised stop 190 can be made of foam rubber or other suitable material.

Figure 2:
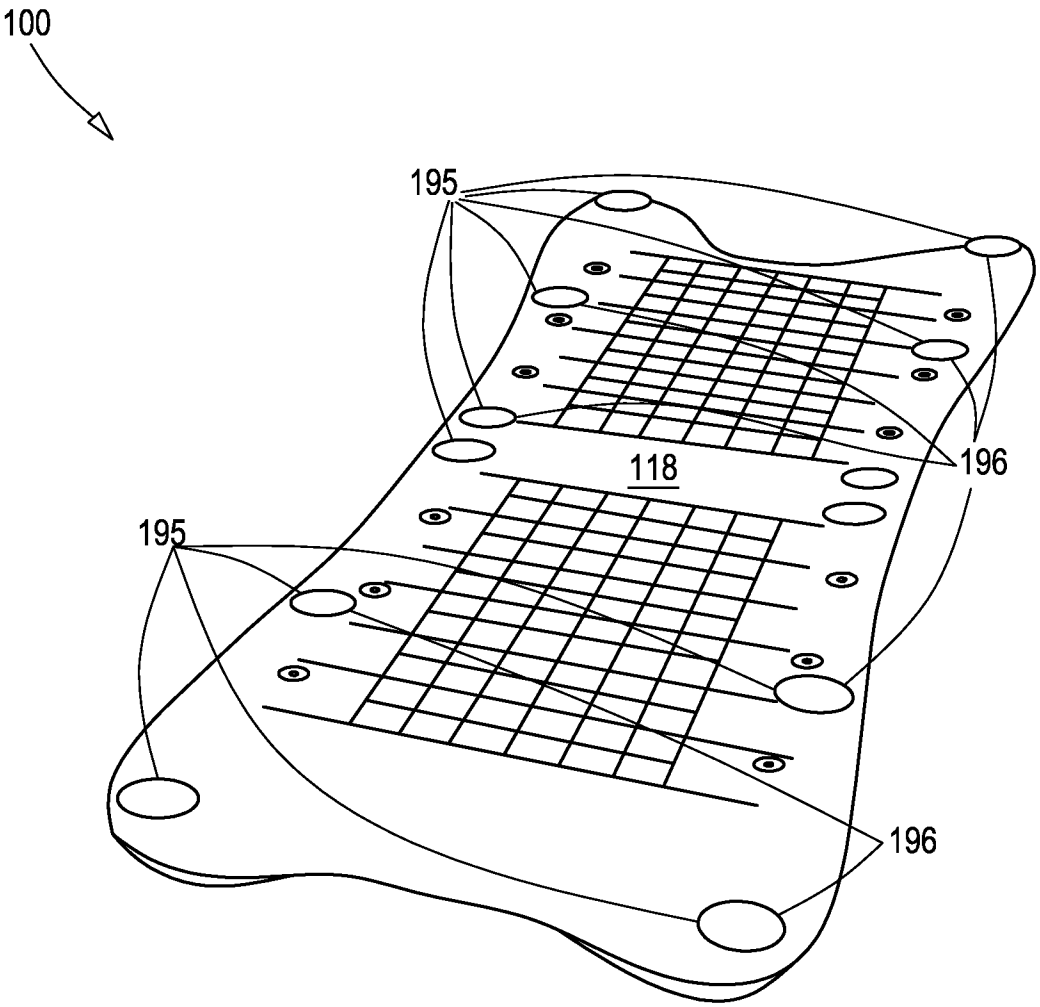
FIG. 2 illustrates a top perspective view of a bottom of a board exercise device, in accordance with one embodiment of the present invention.

FIG. 2 illustrates a bottom perspective view of a board exercise device 100, in accordance with one embodiment of the present invention.

The board exercise device 100 includes a plurality of slip-resistant pads 195 disposed on a bottom surfacing 118 of the board exercise device 100. The slip-resistant pads 195 prevent the board exercise device 100 from slipping or moving on a surface that the board exercise device 100 is placed on while in use. The slip-resistant pads 195 have a generally circular shape 196 but can be any suitable shape and be disposed anywhere along the bottom surfacing 118 of the board exercise device 100.

Figure 3:
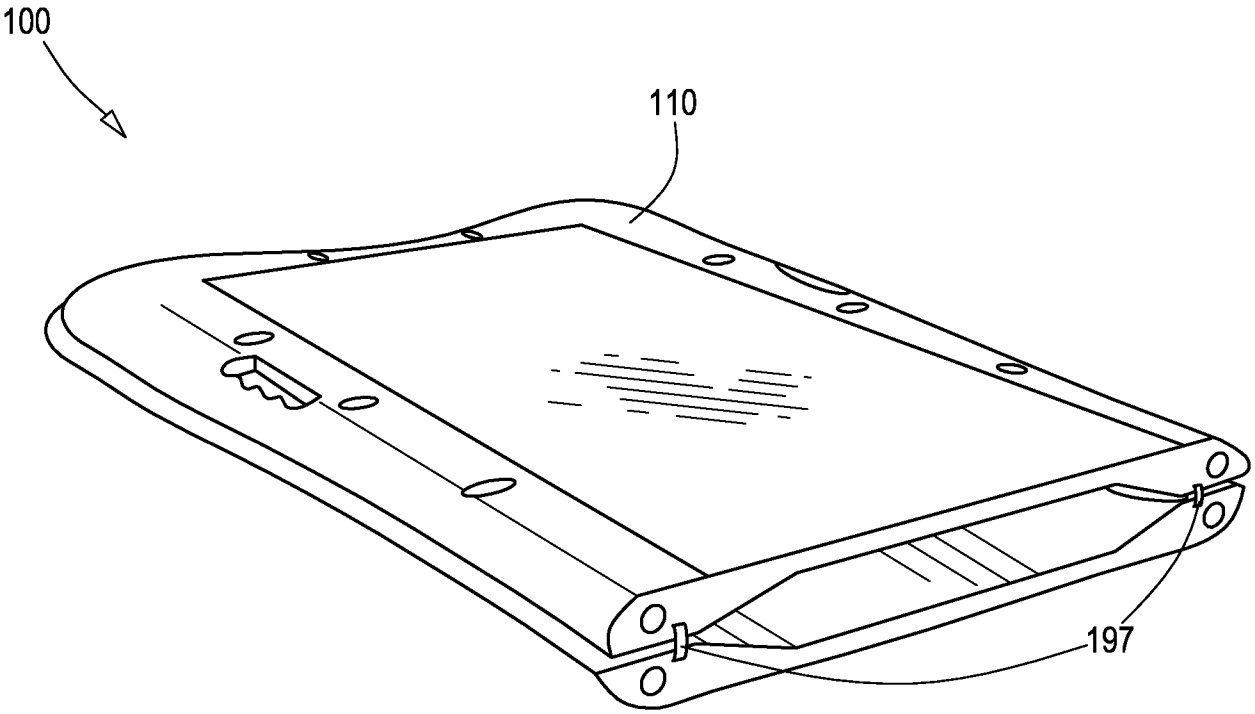
FIG. 3 illustrates a top perspective view of a board exercise device in a folded position, in accordance with one embodiment of the present invention.

FIG. 3 illustrates a top perspective view of a board exercise device 100 in a folded position, in accordance with one embodiment of the present invention.

The board exercise device 100 includes one or more hinges 197. The one or more hinges 197 are attached to the pair of planar boards 110 to allow the pair of planar boards 110 to fold-up. The one or more hinges 197 are made of stainless steel or other suitable material.

Figure 4:
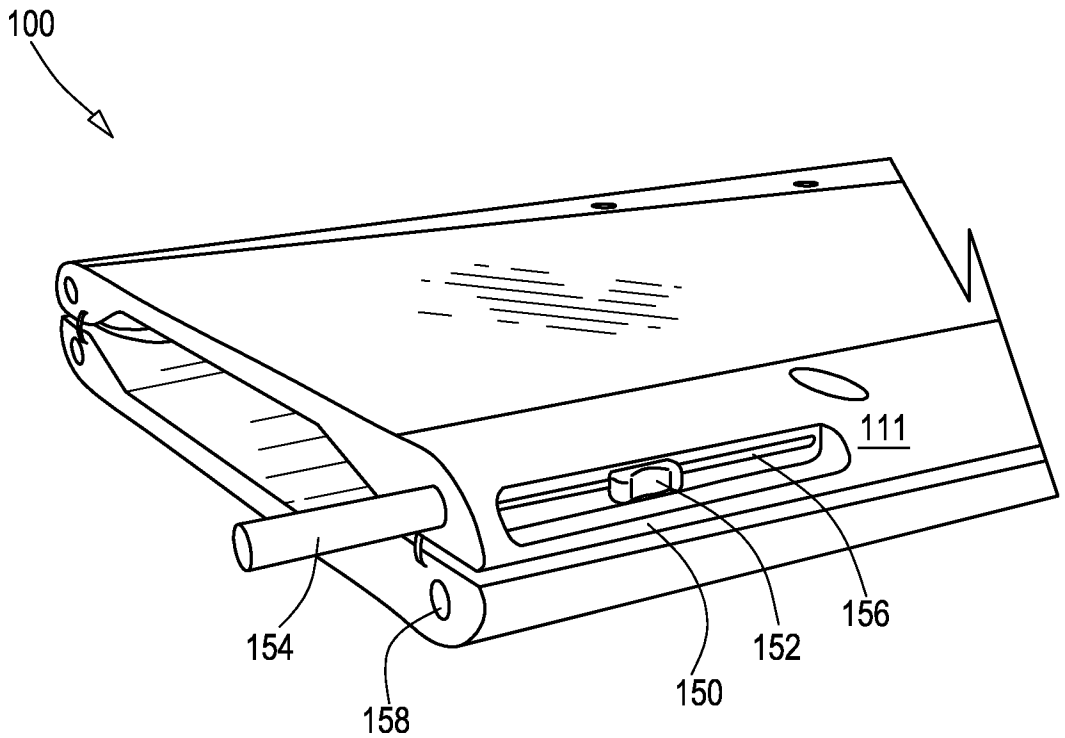
FIG. 4 illustrates a side perspective view of sliding adjustment of a board exercise device in a folded position, in accordance with one embodiment of the present invention.

FIG. 4 illustrates a side perspective view of a sliding adjustment 150 of a board exercise device 100 in a folded position, in accordance with one embodiment of the present invention.

The sliding adjustment 150 includes a sliding button 152 and an extendable bolt 154. The sliding button 152 can be disposed along a side 111 of the pair of planar boards 110 or be disposed on any other suitable portion of the pair of planar boards 110. The sliding button 152 can be slid in a horizontal direction within a track 156. The extendable bolt 154 can be attached to the sliding button 152 and moves with the sliding button 152 as the sliding button 152 is moved within the track 156. The extendable bolt 154 can be extended into a single receiving aperture 158 that receives the extendable bolt 154 as the sliding button 152 is moved within the track 156 thereby securing the board exercise device 100 in a flat position. The further the extendable bolt 154 is extended into the single receiving aperture 158, the greater the board exercise device 100 is secured in a flat position.

The board exercise device can be manufactured through a process known as rotational molding. There will be two boards. One for the home consumer and the other will be a commercial model. Rotational molds are significantly cheaper than other types of molds. Very little material is wasted using the manufacturing process, and excess material can often be reused, making it a very economically and environmentally friendly manufacturing process. Rotational molding offers design advantages over other molding processes. With proper design, parts assembled from several pieces can be molded as one part, reducing fabrication costs.

The process also has inherent design strengths, such as consistent wall thickness and strong outside corners that are virtually stress free. For additional strength, reinforcing ribs can be designed into the board exercise device. Along with being designed into the board exercise device, the reinforcing ribs can be added to the mold. Another advantage lies in the molds themselves. Since the molds require less tooling, they can be manufactured and put into production much more quickly than other molding processes. Rotational molding is also the desired process for short runs and rush deliveries. The molds can be swapped quickly or different colors can be used without purging the mold. With other processes, purging may be required to swap colors.

The board exercise device is a piece of training equipment that can be utilized for regular exercise and training, injury prevention and rehabilitation. The board exercise device can be utilized in gyms, at home, rehabilitation centers, sports league training centers and/or any other place where exercises can be performed. The board exercise device allows users to perform various cardio and strength training exercises to improve overall health, fitness, injury prevention and improve and accelerate the process of muscle rehabilitation. These exercises can be performed on the board exercise device without using any other type of equipment and can be utilized in an approximate nine foot by five foot area. The use of resistance bands instead of heavy metal or iron weights makes it safer for the users and utilization by a user age range from five years of age and up. Most weight training exercises can be performed on the board exercise device. The board exercise device is made up of two approximately three foot and five inch by three foot coated wood or plastic boards attached together to allow the board exercise device to be folded together for easy storage and transport. On the top coated wood or plastic board there is an approximately quarter inch rubber mat glued and/or nailed down in order to make a training surface softer and safer. The user will then step on the top rubber surface of the unfolded board exercise device and perform a desired exercise. If the user would like to utilize the slide board function, they can place the hard, smooth and transparent plastic or PLEXIGLAS® and non-stick shoe cover on top of the board exercise device and perform a slide board exercise. The PLEXIGLAS® has non-slip material attached to its bottom that holds the PLEXIGLAS® and the non-stick shoe cover on top of the board exercise device.

The board exercise device can be utilized to perform a variation of cardio and strength exercises and routines. The board exercise device allows a user to perform any suitable exercise using every suitable single body muscle. Results can be easily achieved using the sliding board for lower body strength, cardio exercise and stability and balance training. Arms, back, shoulders and abs are easy to be worked out when using the one or more banded exercise devices. Total body exercises are also another way to utilize the board exercise device when lower and upper body muscles work together in strength and cardio movements incrementing coordination, balance and focus, adding a psychological use for the board exercise device. The board exercise device is made up of two coated wood or plastic boards hinged together so they can fold together in order to easily store away and carry around the board exercise device. The board exercise device has two handles attached to make handling the board exercise device easier.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A board exercise device, comprising:

a pair of planar boards having a top surfacing with a perimeter and an outer edge;

a plurality of built-in attachment bars coupled to the perimeter of the pair of planar boards, the built-in attachment bars each include an attachment aperture and a stem portion; and one or more banded exercise devices coupled to the built-in attachment bars, the built-in attachment bars allow a user to grasp the one or more banded exercise devices and perform an exercise;

a storage slot disposed on one or more locations of the board exercise device;

a sliding adjustment disposed on a side of the pair of planar boards, the sliding adjustment including a sliding button, an extendable bolt and a track, the sliding adjustment keeping the board exercise device flat; and a pair of handles built-into a top of the outer edge of the pair of planar boards, the pair of handles includes a plurality of ergonomic ridges that accommodate a user's hand while the user is grasping the pair of handles.

2. The board exercise device according to claim 1, the board exercise device includes a slide board placed over the top surfacing of the pair of planar boards.

3. The board exercise device according to claim 1, wherein the pair of planar boards is folded out flat and is utilized in a selected one of a standing position and a sitting position.

4. The board exercise device according to claim 1, wherein the top surfacing is slip-resistant and flat.

5. The board exercise device according to claim 4, wherein the top surfacing is made of rubber.

6. The board exercise device according to claim 1, wherein the pair of planar boards are made of coated wood or plastic board.

7. The board exercise device according to claim 1, wherein the one or more banded exercise devices is a selected one of a banded handle, a banded belted loop and a banded exercise hook.

8. A board exercise device, comprising:

a pair of planar boards having a top surfacing with a perimeter and an outer edge;

a plurality of built-in attachment bars coupled to the perimeter of the pair of planar boards, the built-in attachment bars each include an attachment aperture and a stem portion;

one or more banded exercise devices coupled to the built-in attachment bars, the built-in attachment bars allow a user to grasp the one or more banded exercise devices and perform an exercise;

a storage slot disposed on one or more locations of the board exercise device;

a sliding adjustment disposed on a side of the pair of planar boards, the sliding adjustment including a sliding button, an extendable bolt and a track, the sliding adjustment keeping the board exercise device flat;

a pair of handles built-into a top of the outer edge of the pair of planar boards, the pair of handles includes a plurality of ergonomic ridges that accommodate a user's hand while the user is grasping the pair of handles; and a slide board placed over the top surfacing of the pair of planar boards, the slide board includes a top surfacing, a bottom surfacing and a pair of ends.

9. The board exercise device according to claim 8, wherein the pair of planar boards is folded out flat and is utilized in a standing position.

10. The board exercise device according to claim 8, wherein the pair of planar boards is folded out flat and is utilized in a sitting position.

11. The board exercise device according to claim 8, wherein the top surfacing of the pair of planar boards is slip-resistant.

12. The board exercise device according to claim 8, wherein the top surfacing of the pair of planar boards is flat.

13. The board exercise device according to claim 8, wherein the top surfacing of the pair of planar boards is made of rubber.

14. The board exercise device according to claim 8, wherein the pair of planar boards are made of coated wood or plastic board.

15. The board exercise device according to claim 8, wherein the one or more banded exercise devices is a selected one of a banded handle, a banded belted loop and a banded exercise hook.

16. The board exercise device according to claim 8, wherein the slide board is made of a hard, smooth and transparent plastic.

17. The board exercise device according to claim 8, wherein the user slides along the slide board as part of a cardiovascular type of exercise.

18. The board exercise device according to claim 8, wherein the top surfacing of the slide board has a plurality of apertures that can receive and secure the one or more banded exercise devices to allow the user to utilize the one or more banded exercise devices.

19. The board exercise device according to claim 8, wherein the slide board includes a raised stop disposed on each of the pair of ends of the slide board to prevent the user from sliding off of the top surfacing.

20. The board exercise device according to claim 19, wherein the raised stop is made of form rubber.

* * * * *